US005167338A

United States Patent [19]

Kick

[11] Patent Number: 5,167,338

[45] Date of Patent: Dec. 1, 1992

[54] SHAKE AND POUR END CLOSURE WITH STAY OPEN LID

[76] Inventor: James Kick, 210 Aspen Village, Ellisville, Mo. 63021

[21] Appl. No.: 688,971

[22] Filed: Apr. 22, 1991

[51] Int. Cl.[5] ..... B65D 51/18

[52] U.S. Cl. ..... 220/253; 220/254; 220/258; 220/265; 222/480; 222/541

[58] Field of Search ..... 220/254, 253, 256, 258, 220/265, 266, 268; 222/541, 565, 480, 555

[56] References Cited

U.S. PATENT DOCUMENTS

| | | | |
|---|---|---|---|
| 2,961,132 | 11/1960 | Ankney | 222/480 |
| 3,874,580 | 4/1975 | Weatherhead, III | 220/266 X |
| 3,912,128 | 10/1975 | Ziemann et al. | 222/541 |
| 4,274,563 | 6/1981 | Otterson | 222/480 |
| 4,489,864 | 12/1984 | Davis | 222/541 |
| 4,541,541 | 9/1985 | Hickman et al. | 220/253 |
| 4,567,995 | 2/1986 | Kreiseder et al. | 220/253 |
| 4,598,837 | 7/1986 | Kreiseder et al. | 220/253 |
| 4,611,725 | 9/1986 | Kacalieff | 220/253 |
| 4,792,054 | 12/1988 | Weidman | 220/253 X |
| 4,969,572 | 11/1990 | Van Kerkhoven et al. | 220/253 |

*Primary Examiner*—Stephen Marcus
*Assistant Examiner*—Vanessa Caretto
*Attorney, Agent, or Firm*—Polster, Lieder, Woodruff & Lucchesi

[57] ABSTRACT

An end closure for a shake and pour container is disclosed having a cover which is mounted on a canister type container. The cover has a rotor rotatably mounted on the cover. The cover has a break-away, hinged lid formed therein with the lid having a tab extending out from the lid beyond the hinge line. Upon applying a downward force on the lid, the lid may be broken away from the cover and rotated downwardly into the container along the hinge line thus opening the container. As the lid rotates down, the tab is also broken away from the cover and rotates upwardly above the level cover so as to be engaged by the rotor thereby to hold the lid in its full open position.

6 Claims, 1 Drawing Sheet

SHAKE AND POUR END CLOSURE WITH STAY OPEN LID

BACKGROUND OF THE INVENTION

This invention relates to an end closure for a shake and pour container, and more particularly, to such an end closure which has a break open frangible lid which in its closed position seals the container and which in its open position provides access to the contents of the container.

Shake and pour containers are well known. Such containers are often utilized for powdered or granular food products, such as grated cheese, coffee creamer, and coffee sugar. End closures for these shake and pour containers generally include a cover which is mounted to one end of a canister-type container and which has a frangible, push-open lid which is sealed to the cover when closed. A rotor having an opening therein is rotatably mounted on the front cover. The container is opened by pushing the frangible lid inwardly thereby to break open the container and to bend the lid along a hinge line down into the container. The rotor opening may then be rotated so as to be in aligned with the cover opening so that the contents of the container may be poured or shaken out.

However, with such prior art plastic end closures, the molded in place hinge typically has a "memory" such that after opening of the lid, the lid tends to spring back at least partially toward its closed position thus at least partially blocking the pouring or shaking of the contents from the container.

In an effort to prevent such push-open plastic end closure lids from springing back and partially blocking the pouring opening, certain prior art end closures were provided with means for engaging the lid and retaining the push open lid in its full open position. One such example of such an end closure is disclosed in my prior U.S. Pat. No. 4,960,572 which utilizes a tab on the underside of the frangible lid which, when pushed to its fully open position, engage a gripping member molded on the underside of the cover to lock the lid in its fully open position. However, in order for the locking tab to work, the lid must be fully open. In use, many consumers may not push the lid to its fully opened position so that the locking tab engages the gripping member.

SUMMARY OF THE INVENTION

Among the several objects and features of the present invention may be noted the provision of a plastic end closure for a container which has a cover, a frangible lid molded in place in the cover for sealing the contents of the container and which may be readily, manually broken away from the cover to permit access to the container and to provide a tamper-proof seal;

The provision of such an end closure for a container which does not require the consumer to fully open the lid nor which requires any consumer education to properly utilize the stay open lid of the present invention;

The provision of such an end closure which utilizes a simple mold and which does not require any additional resin to form the locking means for the stay open lid;

The provision of such an end closure which is economical to manufacture, which may be readily manufactured, and which is easy for the consumer to use.

Other objects and features of this invention will be in part apparent and in part pointed out hereinafter.

Briefly stated, an end closure of this invention is intended for use as an end closure for a container. The end closure includes a cover which is mountable on one end of the container and which has a rotor, having an opening extending therethrough, rotatably mounted on the outer surface of the cover. The cover includes a push open frangible lid defined in the cover by a frangible break away line and by a hinge line. The lid includes a tab extending from the lid beyond the hinge line. When the lid is broken away from the cover and is pushed inwardly of the container, an opening results in the cover. The tab adjacent the hinge line projects up above the level of the cover and cooperates with the rotor so as to hold the lid in its open position.

BRIEF DESCRIPTION OF THE DRAWINGS

Corresponding reference characters indicate corresponding parts throughout the several views of the drawings

DESCRIPTION OF A PREFERRED EMBODIMENT

Figure 2:
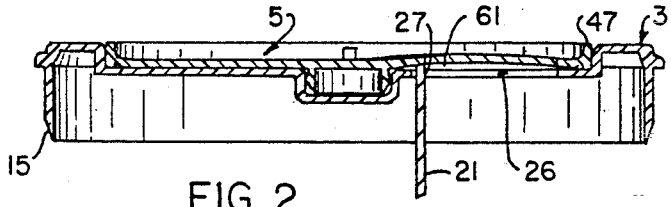
FIG. 2 is a view similar to FIG. 1, except that the rotor is turned so as to close the lid opening in the cover.

Referring now to the drawings, an end closure of the present invention is illustrated in its entirety by reference character 1. The end closure is shown to be mounted on one end of a shake and pour canister-type container C (as shown in phantom lines in FIG. 1). End closure 1 includes a cover, as generally indicated at 3, and a rotor 5 rotatably mounted on the cover for opening and closing access to the contents of the container.

Figure 3:
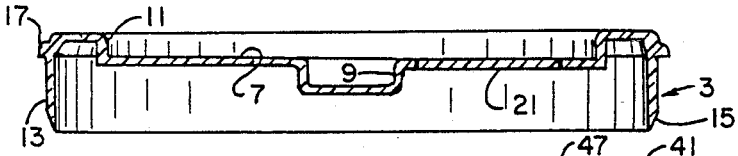
FIG. 3 is a cross sectional view of the cover with the rotor removed.
Figure 4:
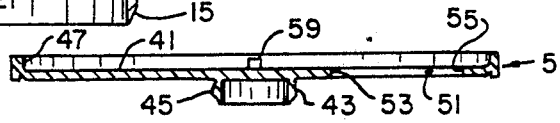
FIG. 4 is a cross sectional view of the rotor.

More particularly, cover 3 is a one-piece member (as best shown in FIG. 3) molded of a suitable synthetic resin material, such as styrene or polyethylene, having a generally planar center plate or face 7 which has a central closed socket opening or recess 9 at the center thereof. The cover further has an upwardly extending step 11 and a downwardly extending skirt 13. The outer diameter of skirt 13 is sized such that it will fit snuggly within the end of a canister C. The bottom end of skirt 13 is beveled, as indicated at 15, so as to facilitate the insertion of the skirt into the end of canister C. A suitable adhesive (not shown) is preferably applied to the outer surface of the skirt so as to sealably secure the end closure 1 of this invention to canister C. Further, an outwardly extending flange 17 is positioned around the upper portion of skirt 13 such that when the skirt is inserted into canister C, flange 17 bears against the upper edge of the canister and then acts as a stop so as to limit the insertion of the end closure into the canister.

In accordance with this invention, a part circular, break open lid 21 is integrally formed in the center plate 7 of cover 3. More particularly, lid 21 is defined by an outer curvilinear, frangible or break away line 23 which is generally concentric with the center of the cover and by a straight chord-like hinge line 25. In use, when sufficient manual downward pressure is applied to the lid, the lid will break free of the cover along the frangible line 23 and the lid will pivot downwardly into the canister along hinge line 25 thereby to form a semi-circular opening 26 in cover 3 generally of the shape of lid 21.

Figure 1:
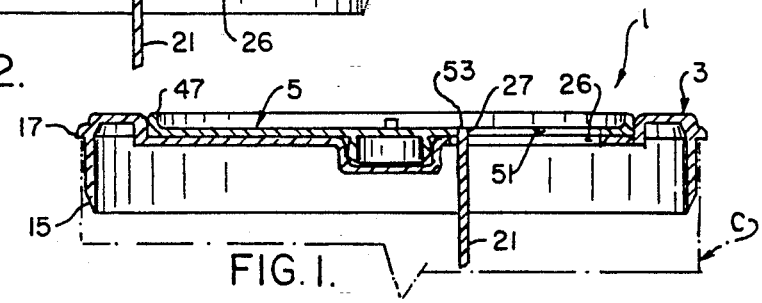
FIG. 1 is a cross sectional view of the end closure of this invention sealably mounted to one end of a container (shown in phantom) with the end closure comprising a cover and rotor rotatably mounted on the cover, with the cover having a hinged lid formed in the cover shown its fully open position.
Figure 5:
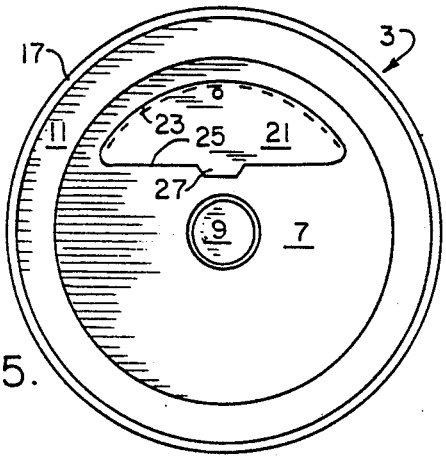
FIG. 5 is a top plan view of the cover shown with the frangible lid molded in place in the plane of the cover, the lid having a curvilinear frangible outer edge and chord-like hinge line with a tab extending radially inwardly from the lid beyond the hinge line.
Figure 6:
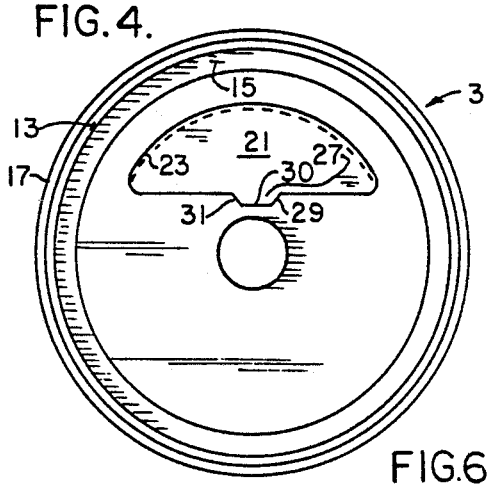
FIG. 6 is a bottom plan view of the cover.

In accordance with this invention, a tab 27 integral with lid 21 is formed in the plane of the lid so as to extend radially inwardly toward the center of the cover from hinge line 25, as shown in FIG. 5. More specifically, tab 27 is defined by frangible lines 29, 30, and 31. Thus, when lid 21 is broken clear of the cover and forced downwardly into the container along hinge line 25, the frangible lines 29, 30 and 31 defining the tab will also break clear of the cover and allow the tab to pivot upwardly above the level of surface 7 of the cover (as shown in FIGS. 1 and 2).

Figure 8:
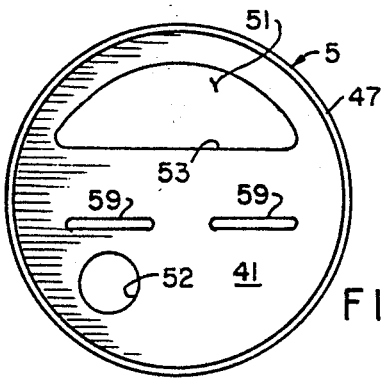
FIG. 8 is a top plan view of the cover.

Rotor 5 includes a planar center plate 41 having a downwardly extending center stud 43 on the bottom thereof. Stud 43 has a slightly enlarged bottom end, as indicated at 45, so that the stud may be snapped into center socket opening or recess 9 formed in cover 3 so as to rotatably mount the rotor on the cover. As best shown in FIG. 8, an upwardly extending lip 47 extends around the outer periphery of the rotor so as to help stiffen the rotor and to maintain the rotor in a generally flat condition. An enlarged "smiled-shaped" opening 51 is provided in the rotor of such a size and shape so as to be generally similar to opening 26 provided in the cover. Thus, at one relative rotary position of the rotor relative to the cover, opening 51 in the rotor will be in register with opening 26 in the cover. A smaller product dispensing circular opening 52 is also provided in the rotor which may be positioned in register with opening 26 in the event a smaller quantity of the product is desired to be poured or shaken from the canister C.

Figure 7:
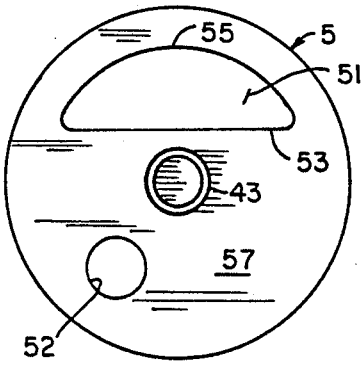
FIG. 7 is a bottom plan view of the rotor illustrating a central boss adapted to rotatably snap-fit within a socket or recess provided in the cover.

Referring particularly to opening 51, it will be seen that this opening is defined by a straight chord-like inner edge 53 and a curvilinear outer edge 55. It will further be noted that smaller opening 52 is positioned in the rotor relative to large opening 51 such that a region 57 (see FIG. 7) of the rotor between openings 51 and 52 is provided of sufficient size such that when this area of the rotor is in register with opening 26 in the cover, the rotor effectively seals opening 26 and closes the container. Further, a pair of upstanding ribs 59 are molded on the upper face of the rotor so as to permit the user to readily grip and rotate the rotor.

In use, after filling of the container with product, the product will be sealed in the container by end closure 1 of this invention inasmuch as lid 21 is integral with cover 3 and closes opening 26. In use, when a consumer wishes to open end closure 1, rotor 5 is rotated relative to the cover such that opening 51 is in register with lid 21. If the consumer sees that the break-away lid 21 has been partly or fully opened, this is evidence of possible tampering. Assuming there is no evidence of tampering, the end user applies or presses lid 21 downwardly into the container thus causing the lid to break free of the container along curvilinear frangible line 23 and also causing the tab 27 to break free of the cover along frangible lines 29, 30 and 31. As lid 21 is forced downwardly into the container, the lid is rotated downwardly about hinge line 25 and tab 27 rotates upwardly above the upper planar surface 7 of the cover so as to assume its position generally as shown in FIGS. 1 and 2. It will be noted that with the rotor in position such that rotor opening 51 is in register with cover opening 26, tab 27 bears against the chord-like straight edge 53 on the rotor (as shown in FIG. 1) and thus lid 21 is positively held by the rotor in its full open position. Upon rotating rotor 5 such that opening 51 is out of register with opening 26, tab 27 projects up above cover surface 7 and thus forces rotor upwardly, as shown in FIG. 2 on an exaggerated scale, such that the rotor cooperates with tab 27 to hold the lid 21 in its full open position, even when rotor 5 partly or fully closes opening 26.

It will be appreciated that, within the broader aspects of this invention, means other than stud 43 and recess 9 may be used to rotatably mount rotor 5 on cover 3. For example, the rotor may be rotatably mounted on the cover around its outer periphery in the manner disclosed in the prior U.S. Pat. No. 4,960,572.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An end closure for a container comprising a cover mountable on end of said container, said cover having a generally planar center face, a rotor having an opening therethrough rotatably mounted on said cover, and a break-open lid comprising a portion of said cover center face and defined within said cover by at least one frangible line and by hinge means, said lid having an integral tab portion generally within the plane of said lid and extending from said lid beyond said hinge means, said lid upon breaking said frangible line being movable from a closed position in which said lid is generally within the plane of said cover center to a face open position in which said lid is pivoted downwardly about said hinge means such that at least a portion of said lid extends downwardly into said container through the opening created by breaking of said frangible line and such that said tab portion extends at least partially above said cover center face with said tab portion cooperating with said rotor so as to hold said lid in its open position.

2. The end closure of claim 1 further comprising means for rotatably mounting said rotor on said cover.

3. The end closure of claim 2 wherein said rotor has a bottom face, and wherein said means for rotatably mounting said rotor on said cover comprises a stud on the bottom of said rotor and a center opening in said cover for rotatably receiving said stud.

4. The end closure of claim 3 wherein said stud snap fits into said cover center opening.

5. The end closure of claim 1 wherein said at least one frangible line defining said lid comprises a curvilinear line generally concentric with said cover, and wherein said hinge means comprises a chord-like straight hinge line, said opening in said rotor having a curvilinear outer edge and a chord-like straight edge with the curvilinear and straight edges of said opening in said rotor being generally coextensive with the corresponding curvilinear frangible line and straight hinge line of said lid such that with said lid in its open position, said tab cooperates with said straight chord-like edge of said rotor opening thereby to positively hold said lid in its open position.

6. The end closure of claim 1 wherein said hinge means comprises a hinge line in said cover, and wherein with said lid in its closed position said lid is substantially within the plane of said cover center face, being defined in said cover by one or more frangible lines in said cover extending from said hinge line on the side of said hinge line opposite from said lid.

* * * * *